US006419471B1

(12) United States Patent
Arbogast et al.

(10) Patent No.: US 6,419,471 B1
(45) Date of Patent: Jul. 16, 2002

(54) INTERNAL GEAR MACHINE FOR REVERSED OPERATION IN A CLOSED HYDRAULIC CIRCUIT

(75) Inventors: Franz Arbogast, Heidenheim; Günther Nagel, Steinheim, both of (DE)

(73) Assignee: Voith Turbo GmbH & Co. KG, Heidenheim (DE)

( * ) Notice: Subject to any disclaimer, the term of this patent is extended or adjusted under 35 U.S.C. 154(b) by 0 days.

(21) Appl. No.: 09/786,591

(22) PCT Filed: Jul. 5, 2000

(86) PCT No.: PCT/EP00/06342

§ 371 (c)(1),
(2), (4) Date: Mar. 23, 2001

(87) PCT Pub. No.: WO01/02730

PCT Pub. Date: Jan. 11, 2001

(30) Foreign Application Priority Data

Jul. 6, 1999 (DE) ..... 199 30 910

(51) Int. Cl.[7] ..... F01C 1/10
(52) U.S. Cl. ..... 418/170; 418/126; 418/15
(58) Field of Search ..... 418/126, 170, 418/15

(56) References Cited

U.S. PATENT DOCUMENTS 3,204,564 A * 9/1965 Eltze ..... 418/170
3,525,581 A * 8/1970 Eckerle ..... 418/126
4,392,796 A * 7/1983 Lindtveit ..... 418/170
4,472,123 A * 9/1984 Eckerle et al. ..... 418/126
5,032,069 A * 7/1991 Parsons ..... 418/170

FOREIGN PATENT DOCUMENTS

| | | | | |
|---|---|---|---|---|
| DE | 353 838 | | 6/1922 | |
| DE | 1 528 947 | | 9/1969 | |
| DE | 1936837 | * | 1/1971 | ..... 418/170 |
| DE | 43 38 875 | | 5/1995 | |
| GB | 273002 | | 6/1927 | |
| JP | 55-014964 | | 1/1980 | |
| JP | 57-052694 | * | 3/1982 | ..... 418/126 |
| JP | 05-180173 | * | 7/1993 | ..... 418/170 |
| NL | 160365 | * | 5/1979 | ..... 418/126 |
| WO | WO 95/12070 | | 3/1995 | |

* cited by examiner

*Primary Examiner*—Thomas Denion
*Assistant Examiner*—Theresa Trieu
(74) *Attorney, Agent, or Firm*—Baker & Daniels

(57) ABSTRACT

The invention relates to an internal gear machine for reversed operation in a closed circuit comprising an outer-toothed pinion, an inner-toothed ring gear meshing with the pinion; a housing; a filing that fills the sickle-shaped space between the pinion and the ring gear; the filling comprises two identical filler pieces; a stop pin is provided that is mounted in the housing and against which the filler pieces are supported by their front faces; the housing has two pressure lines and a drain outlet; the filler pieces are symmetrically disposed relative to a plane (symmetrical plane) extending through the center points of the pinion and the ring gear; the two pressure lines are located on both sides of the symmetrical plane viewed in axial direction.

4 Claims, 2 Drawing Sheets

INTERNAL GEAR MACHINE FOR REVERSED OPERATION IN A CLOSED HYDRAULIC CIRCUIT

BACKGROUND OF THE INVENTION

The invention relates to an internal geared wheel machine, in particular an internal geared wheel pump. Such machines are known from numerous publications, for example DE 41 04 397 A1.

WO 95/12070 describes an internal geared wheel machine which has a longitudinally divided filling member.

Problems always arise when machines of the described type are to be driven in reversing operation, and when the pressure range changes. Thus, for example, there are numerous instances of application in which it is desired to operate an internal geared wheel pump both clockwise and counterclockwise. So far there has not yet been any solution for the case when such a pump is to be driven in a closed system.

SUMMARY OF THE INVENTION

Underlying the invention is the problem of indicating an internal geared wheel machine that can be driven in both rotation directions, and which can be installed into a closed system, and namely when the position of the pressure range in the pump changes.

This problem is solved by the features of claim 1.

DESCRIPTION OF THE DRAWINGS

The invention is explained in detail with the aid of the drawing. Therein there is represented in detail the following.

DETAILED DESCRIPTION OF THE INVENTION

Figure 1:
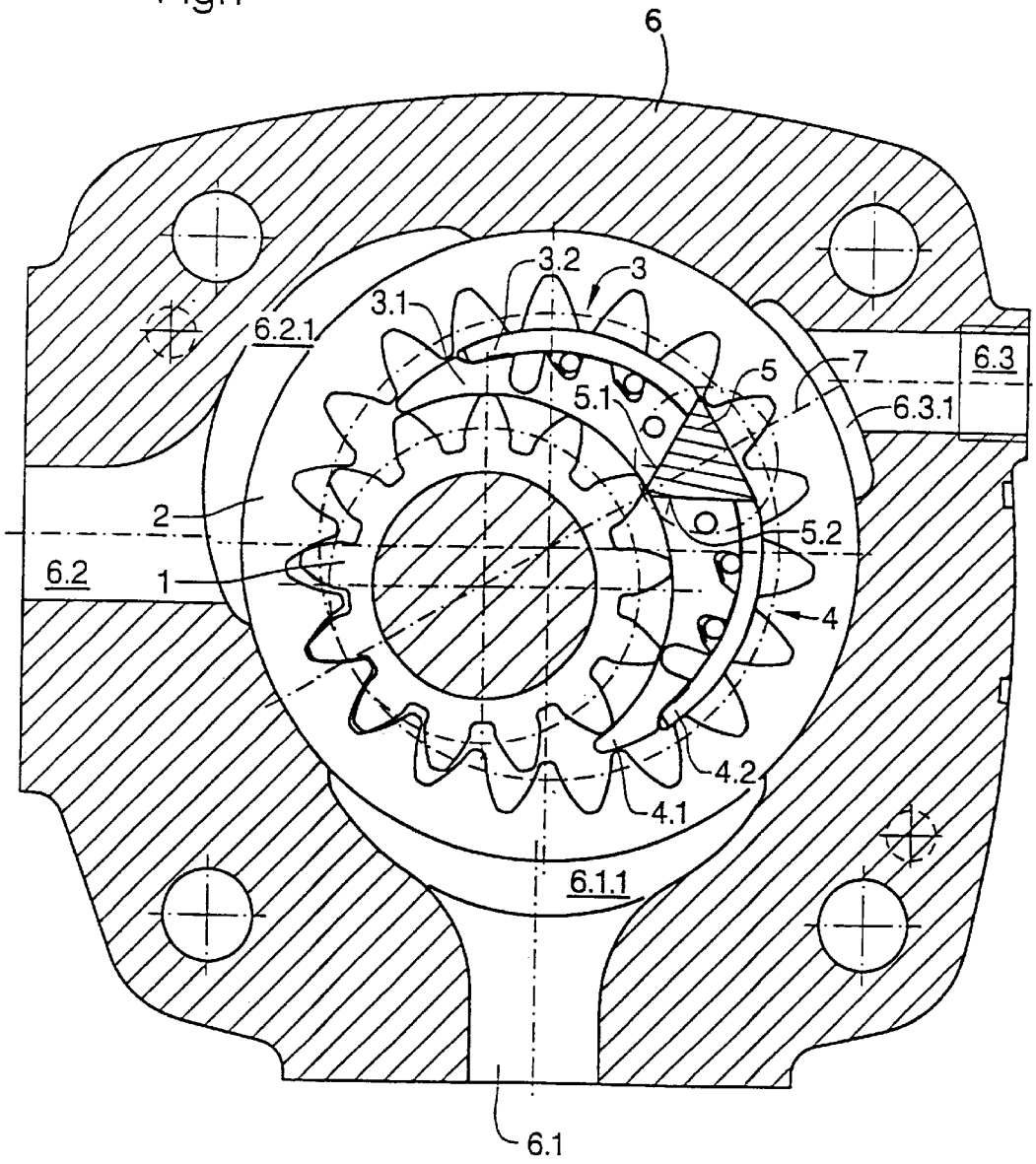
FIG. 1 shows in axially perpendicular section view an internal geared wheel pump.

The internal geared wheel pump shown in FIG. 1 comprises as essential components a pinion 1 with an external toothing, a hollow wheel 2 with an internal toothing, a filling composed of two filling members 3, 4, a stop pin 5, and a housing 6.

Pinion 1 is eccentrically borne with respect to hollow wheel 2. See the midpoints M1 of the pinion and M2 of the hollow wheel. Through the two midpoints M1, M2 there is laid a dot-and-dash straight line. This designates a plane of symmetry, the significance of which will further be explained below.

The sickle-shaped space between the pinion 1 and the hollow wheel 2 is filled by a filling element. The filling/lining comprises the two filling members 3, 4. The stop 5 is borne in the housing 6 with a certain amount of play. As one sees, the stop has two support surfaces 5.1, 5.2. The face surfaces of the two filling members 3, 4 are supported against the support surfaces 5.1, 5.2.

The two filling members 3, 4, furthermore, are divided lengthwise in a manner known per se. They are composed, therefore, of an inner part 3.1, 3.2, respectively 4.1, 4.2. The filling members 3, 4 could just as well, however, consist of a single part.

The housing has two pressure connections 6.1, 6.2. The two pressure connections lie on both sides of the axis of symmetry 7. The housing further has a leakage outlet 6.3. In the present case, this lies exactly in the plane of symmetry 7.

Important also is the following feature. The arrangement is made in such a way that the two filling members 3,4 lie symmetrically to the plane of symmetry 7. Also, the stop pin 5 is arranged in such manner that the plane of symmetry 7 runs through it, and divides it into two parts symmetrical to each other. As one sees, the plane of symmetry 7 runs through the tip of the stop pin 5 that is formed from the two support surfaces 5.1, 5.2.

As one further sees, the housing 6 has recesses 6.1.1, 6.2.1, 6.3.1. These are connected to the respective pressure connections 6.1, 6.2, respectively to the leakage outlet 6.3.

Figure 2:
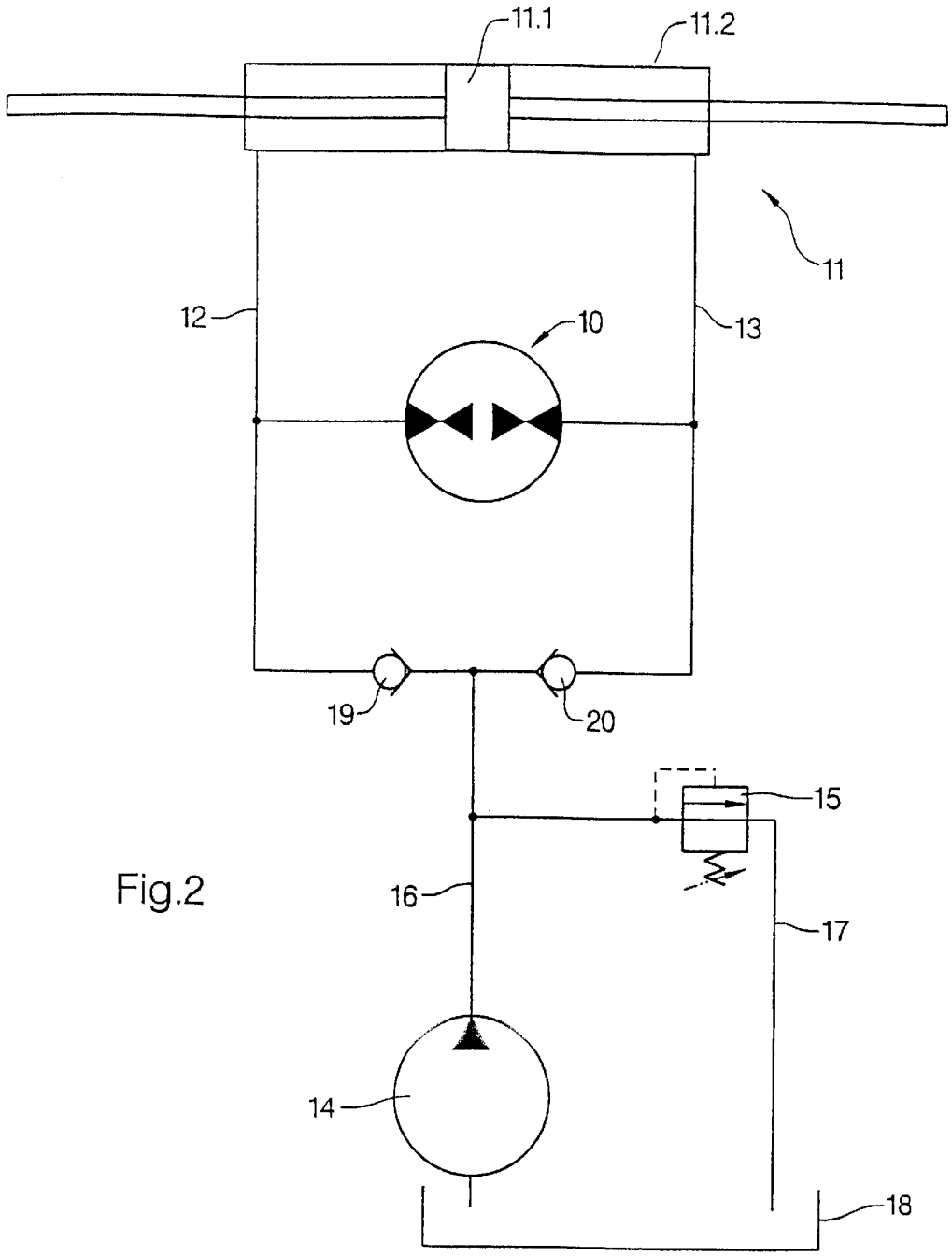
FIG. 2 a circuit with an internal geared wheel according to the invention.

In the circuit plan represented in FIG. 2, one perceives a pump 10 according to the invention. The pump 10 is a component of a closed circulation system. One perceives, further, a hydraulic unit 11, comprising a double-acting piston 11.1 and a cylinder 11.2. The piston 11.1 is slidable in both directions in the cylinder 11.2, depending on which one of the two lines 12, 13 the cylinder is acted upon with a pressure medium by means of the pump 10. Depending on the direction of rotation of the pump 10, the pressure medium is conveyed either into line 12 or into line 13.

One perceives a further pump 14, a pressure regulator 15, a line 16, a line 17, as well as a supply container 18.

In the internal geared wheel pump represented in FIG. 1, there necessarily occurs a leakage. The leakage amount emerges through the leakage outlet 6.3 in FIG. 1. This amount must be steadily replaced, for this there serves the pump 14. This latter takes pressure medium—in general an oil—out of the supply container 18. It conveys it through the line 16. The pressure regulator 15 provides that the medium pressure does not exceed a certain upper value. If the medium pressure exceeds such a value, then the pressure regulator opens, so that a certain amount of pressure medium again flows over the line 17 and back into the supply container 18. The oil regulated up to the upper value flows onward in line 16 and passes through one of the two non-return valves 19 and, depending on the direction of rotation, into one of the two lines 12, 13 and therewith onto one of the two sides of the piston 11.1.

while the internal geared wheel pump 10 of the invention conveys up to high pressures, such as for example 300 bar, the pump 14 as feed pump needs attain only substantially lower pressures, for example 10 bar.

What is claimed is:

1. An internal geared wheel machine for reversing operation in closed circulation, said machine comprising:

a housing having two pressure connections and a leakage outlet;

an externally toothed pinion disposed in said housing;

an internally toothed hollow wheel disposed in said housing, said hollow wheel meshing with said pinion;

a filling that fills a sickle-shaped space between sad pinion and said hollow wheel, said filling comprising two like-construction filling members; and a stop pin disposed in said housing, said stop pin having face surfaces against which said filling members are supported;

said filling members being arranged symmetrically to a plane of symmetry that runs through respective midpoints of said pinion and wheel;

said two pressure connections lying on respective opposite sides of said plane symmetry.

2. The internal geared wheel machine of claim 1 wherein said leakage outlet lies approximately in the plane of symmetry.

3. The internal geared wheel machine of claim 2 wherein said machine is a component of a closed system.

4. The internal geared wheel machine of claim 1 wherein said machine is a component of a closed system.

* * * * *